United States Patent [19]

Schmid et al.

[11] Patent Number: 4,964,196

[45] Date of Patent: Oct. 23, 1990

[54] CLEANING MACHINE FOR TEXTILE FIBRES WITH MEANS FOR REMOVING DUST

[75] Inventors: René Schmid, Niederneunforn; Jürg Koller, Pfyn, both of Switzerland

[73] Assignee: Maschinenfabrik Rieter AG, Winterthur, Switzerland

[21] Appl. No.: 470,684

[22] Filed: Jan. 26, 1990

[30] Foreign Application Priority Data

Jan. 26, 1989 [CH] Switzerland ..... 242/89

[51] Int. Cl.[5] ..... D01G 9/20

[52] U.S. Cl. ..... 19/200; 19/205; 19/85

[58] Field of Search ..... 19/24, 39, 50, 59, 85, 19/95, 97.5, 200, 204, 205

[56] References Cited

U.S. PATENT DOCUMENTS

| | | | |
|---|---|---|---|
| 4,102,017 | 7/1978 | Foerster | 19/205 |
| 4,135,276 | 1/1979 | Handschuch et al. | 19/200 |
| 4,479,286 | 10/1984 | Brown et al. | 19/200 |
| 4,625,368 | 12/1986 | Leifeld . | |
| 4,637,096 | 1/1987 | Wise et al. | 19/200 |
| 4,736,493 | 4/1988 | Haass-Zöllick et al. | 19/200 |
| 4,797,976 | 1/1989 | Leifeld et al. | 19/200 |
| 4,854,013 | 8/1989 | Pinto et al. | 19/200 |

FOREIGN PATENT DOCUMENTS

| | | | |
|---|---|---|---|
| 83576 | 9/1989 | European Pat. Off. . | |
| 345749 | 12/1921 | Fed. Rep. of Germany . | |
| 3030278 | 2/1982 | Fed. Rep. of Germany . | |
| 3333750 | 4/1985 | Fed. Rep. of Germany . | |
| 1220618 | 5/1960 | France . | |
| 266628 | 8/1968 | U.S.S.R. | 19/200 |
| 2000534 | 6/1977 | United Kingdom | 19/85 |
| 2079337 | 1/1982 | United Kingdom | 19/200 |

*Primary Examiner*—Werner H. Schroeder
*Assistant Examiner*—John J. Calvers
*Attorney, Agent, or Firm*—Burns, Doane, Swecker & Mathis

[57] ABSTRACT

A coarse cleaning machine for textile fibres including a casing, a horizontal roller rotatably mounted in the casing, the roller being fitted with beater elements and bar grates are arranged on the underside of the roller. Located above and at one end of the roller is an inlet which carries delivery air for conveying the textile fibres in the form of flocks and an outlet is located above and at the other end for the roller. Deflectors which are inclined with respect to the roller axis are arranged above the upper side of the roller between the inlet and the outlet. The deflectors define transfer chambers which deflect the delivery air further in the direction of the axis of the roller. At least part of the transfer chambers are covered by a wall which is permeable to air and dust and a low pressure chamber connected to a suction pipe is located above the wall. The machine can not only separate the coarser impurities through the bar gates but can also suck out the fine dust-like impurities through the wall which is permeable to air and dust, the impurities being sucked into the low pressure chamber and then into the suction pipe.

21 Claims, 1 Drawing Sheet

CLEANING MACHINE FOR TEXTILE FIBRES WITH MEANS FOR REMOVING DUST

FIELD OF THE INVENTION

The invention relates to a cleaning machine for textile fibres conveyed in a current of delivery air, the machine including a horizontal roller fitted with beater elements, bar grates on the underside of the roller, an inlet for delivery of air arranged above and at one end of the roller, an outlet above and at the other end of the roller, and deflector plates arranged between the inlet and outlet and sloping towards the axis of the roller so as to define transfer chambers for the current of air traveling around the axis of the roller.

BACKGROUND

At least one such cleaning machine is known and available on the market. It serves the purpose of opening the fibre flocks in the delivery air and removing the impurities therein. The fibre material is pulled over the bar grates and also beaten to some degree through the impact on the transfer chamber limiting walls, whereby impurities are separated from the material. Coarser impurities, as, for example, portions of shell, pass through the bar grates and are then sucked up. In the known machine, however, fine, dust-like impurities remain, at least in the delivery air current and leave the machine together with the fibre material conveyed with the delivery air.

SUMMARY OF THE INVENTION

According to the invention, a cleaning machine of the foregoing type is provided with means for separating fine dust-like impurities from the fibre material.

According to a preferred embodiment of the invention, the machine includes transfer chambers which are at least partly covered by a wall which is permeable to air and dust, above which at least one low pressure chamber is formed by a hood connected to a suction pipe.

Through the wall of the transfer chamber, which is permeable to air and dust, air can be sucked from the transfer chamber by which the very light dust-like particles of dirt can be separated from the fibre material conveyed in the delivery air stream.

The wall of the transfer chamber, which is permeable to air and dust can, for example, be a sieve or a perforated sheet with holes of about 1.5 mm diameter. It can form at least a part of the covering of every transfer chamber or if necessary, of one or some of the transfer chambers.

The low pressure chamber can be assigned to all the transfer chambers collectively. Alternatively, it is possible to arrange separate low pressure chambers for each of the transfer chambers or, respectively, for some of the transfer chambers. In an especially preferred embodiment, means are provided for setting the underpressure in the low pressure chamber or low pressure chambers or the quantity of air extracted from these chambers. For example, an adjustable throttling member can be provided in the suction pipe or between the suction pipe and the low pressure chamber. When several separated low pressure chambers are present, a throttling member can be assigned for each chamber. The throttle member can comprise a throttle valve, slider or similar type of device.

BRIEF DESCRIPTION OF THE DRAWINGS

The cleaning machine according to the invention is illustrated in the accompanying drawings, in which.

DETAILED DESCRIPTION OF THE PREFERRED EMBODIMENTS

Figure 1:
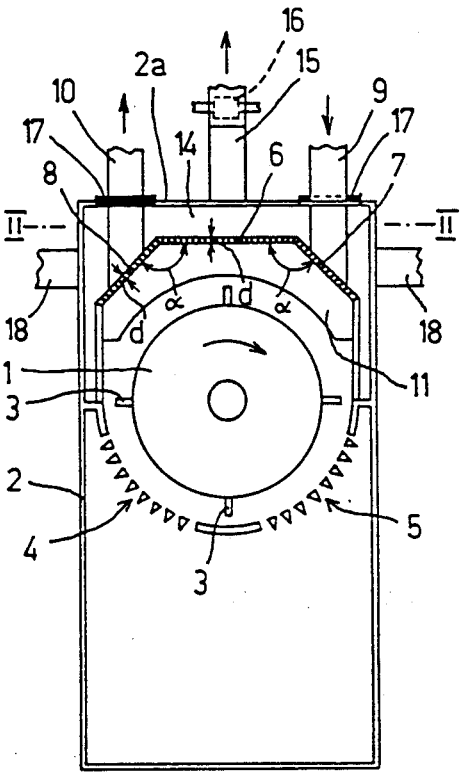
FIG. 1 shows a schematic vertical section through a coarse cleaning machine according to the invention.

The coarse cleaning machine shown in FIGS. 1 to 4 has an opening roller 1, which is supported to rotate in a casing 2 around a horizontal axis and its circumference is fitted with beater rods 3. In operation, the roller 1 is turned in the direction of the arrow according to FIG. 1 by a motor, which is not shown. Two bar grates 4, 5, only schematically represented in FIG. 1, are arranged below the underside of the roller 1.

The upper side of the roller 1 is covered by a wall with a clearance between the circumference of the roller 1 and the wall. The wall includes a horizontal middle section 6 and two lateral sections 7 and 8, which are inclined with respect to a vertical direction at an angle of about 45°. The wall sections 6, 7 and 8 are permeable to air and dust. The three wall sections 6, 7 and 8 are arranged as terraces, which means in cross section, they form approximately three sides of an equilateral trapezium and adjacent ones of these wall sections form an angle (alpha) of approximately 135° with each other. The wall sections 6, 7 and 8 are, for example, formed from perforated plates with holes having a diameter, for example, of about 1.5 mm or from a sieve.

In the wall section 7, at one axial end of the roller 1, an inlet pipe 9 merges from above and in the wall section 8, an outlet pipe 10 merges from above at the other axial end of the roller 1. Three deflector plates 11, 12 and 13 are arranged between the inlet pipe 9 and the outlet pipe 10 such that they are above the upper side of the roller 1 and below the wall sections 6, 7 and 8. The three deflector plates 11, 12 and 13, are arranged at an inclination with respect to the roller axis, so as to define first and second transfer chambers between the upper side of the roller 1 and the wall formed by the wall sections 6, 7 and 8. A hood formed by an upper part 2*a* of the casing 2 defines a low pressure chamber 14, to which a suction pipe 15 is connected.

In operation, the textile fibres in the form of flocks, which are to be cleaned and opened, are led by a current of delivery air to the coarse cleaning machine through the inlet pipe 9. The delivery air with the fibre flocks flows mainly at first around the underside of the rotating roller 1, then through the first transfer chamber between the deflectors 11 and 12, which moves the air axially further in the direction of the axis of the roller 1. The delivery air and fibre flocks then travel again around the underside of the roller 1, then through the second transfer chamber between the deflectors 12 and 13 and again around the underside of the roller 1, in order to leave the machine finally through the outlet pipe 10.

With the circulation around the underside of the roller 1, the fibre flocks are processed through the beater elements 3 so as to be increasingly opened and for impurities to be separated from the fibres. The coarser impurities, as for example, portions of shell, are removed through the bar grates 4 and 5 and sucked out of the space under the bar grates through a suction device, which is not shown. After this, the fibre flocks fly upwards into the succeeding transfer chamber, where they are further opened by the impacts on the wall sections, 6, 7, 8.

Fine, dust-like impurities, which have been separated from the fibres, can only be partially sucked out through the bar grates 4 and 5, whilst the larger part of the dust remains in the delivery air. The wall sections 6, 7, 8 which are permeable to air and dust, the low pressure chamber 14 and the suction pipe 15 also serve the purpose of separating these fine impurities from the delivery air, so that they cannot finally emerge through the outlet pipe 10 with this delivery air and the fibres. The suction pipe 15 is connected to a low pressure source or suction device, which is not shown, which sucks out the dust laden air through the wall sections 6, 7, 8.

Figure 3:
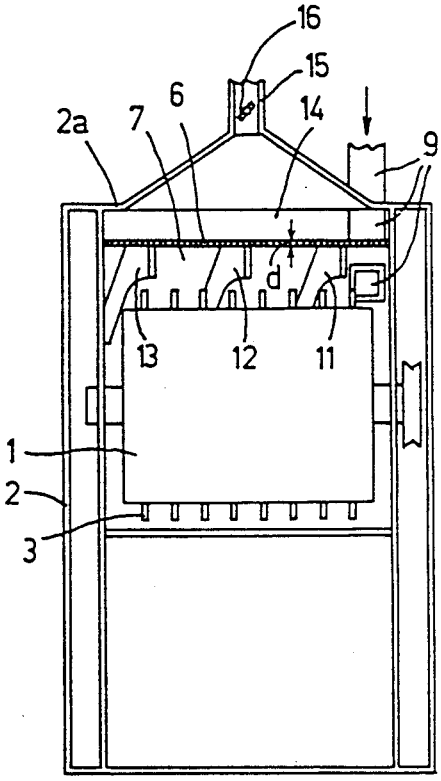
FIG. 3 shows a vertical section of the machine shown in FIG. 1.
Figure 2:
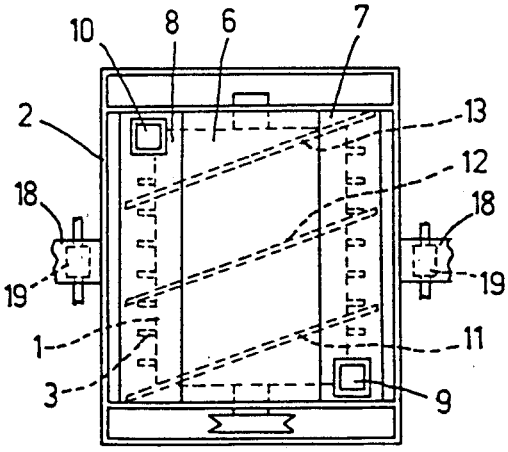
FIG. 2 shows a topview through a section taken along the line II—II in FIG. 1.

The magnitude of the underpressure produced in the low pressure chamber 14 or the amount of air sucked out through the wall sections 6, 7, 8 is adjustable. For example, the underpressure source or the suction source is adjustable or there can be an adjustable throttling member arranged in the suction pipe 15, or, as shown in FIGS. 1 and 3, an adjustable throttle valve 16 can be provided. The amount of air sucked out is so adjusted that it is sufficient to suck out the dust through the pipe 15, so that the dust is not deposited on the upper side of the wall sections 6, 7, 8. In order to observe this, inspection windows 17 are provided in the upper part of the casing 2*a*, as shown in FIG. 1. It can also be expedient to arrange at least a scavenging air inlet 18 in the upper part of the casing 2*a*, through which scavenging air from the surroundings can be sucked into the low pressure chamber 14. The scavenging air inlets 18 likewise contain adjustable throttling members, e.g., throttle valves 19 (FIG. 2).

The underside of the wall sections 6, 7, 8 which are permeable to air and dust, is always kept clean by means of the delivery air flowing through the transfer chambers, respectively, and by means of the fibre flocks conveyed by the delivery air. If the wall sections 6, 7, 8 are perforated, then the holes on the underside of the wall sections facing the roller should not have any sharp edges, so that fibres or impurities cannot be caught. The wall sections 6, 7, 8 can advantageously be formed from perforated sheets which have an electro galvanic coating on the underside. Accordingly, a rounded surface of such a coating then extends a little way into the holes.

In a preferred embodiment of the coarse cleaning machine described above, the wall sections 6, 7, 8 are mainly permeable to air and dust over the entire surface thereof. It is possible, however, to form the wall sections 6, 7, 8 such that they are only permeable in certain places, for example, over only one of the deflectors 11, 12 and 13 defining the transfer chambers or only over a part of the length of these chamber, (seen in the direction of movement of the delivery air through the chambers).

Figure 4:
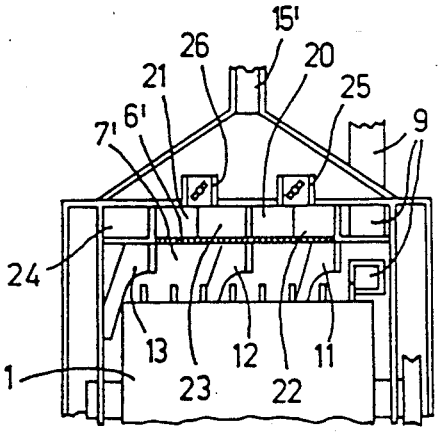
FIG. 4 shows a partial section similar to FIG. 3 of another embodiment of the coarse cleaning machine according to the invention.

In another embodiment, instead of the single low pressure chamber shown in FIGS. 1 and 3, which is assigned to all of the transfer chambers collectively, several separate low pressure chambers can be provided, each of which is assigned to one (or if necessary more than one) of the transfer chambers. Such an arrangement is schematically represented in FIG. 4. The three deflectors 11, 12 and 13 can be seen above the roller 1, which define two transfer chambers, which are covered with a wall which is permeable to air and dust. Sections 6' and 7' of this wall can be seen. Above the wall are first and second low pressure chambers 20 and 21 which are defined by dividing walls 22, 23 and 24. The dividing walls 22, 23 and 24 are aligned with the deflectors 11, 12 and 13, so that each of the low pressure chambers 20 and 21 is aligned with a respective one of the two transfer chambers. The low pressure chambers 20 and 21 are each connected to a suction pipe 15' by means of outlets 25 and 26, respectively. An adjustable throttle valve is arranged in each of the outlets 25 and 26.

Finally, means can be provided for vibrating the wall. For instance, it is feasible to select the thickness (d) of the wall sections 6, 7 and 8 in such a way that these wall sections when in operation, are submitted to vibration, as a result of the angular arrangement, through the impact of the fibre material conveyed in the delivery air.

While the invention has been described with reference to the foregoing embodiments, changes and variations may be made thereto which fall within the scope of the appended claims.

What is claimed is:

1. A cleaning machine for textile fibres conveyed in a current of delivery air, the machine comprising a casing, a horizontal roller fitted with beater elements and rotatably mounted in the casing, grate bars located in the casing on the underside of the roller, an inlet in the casing for delivery of air located at one end of the roller, an outlet in the casing located at the other end of the roller, deflector plates located in the casing between the inlet and the outlet, the deflector plates arranged so as to be inclined with respect to the axis of the roller and define transfer chambers said plates for the current of delivery air which travels around the axis of the roller, an air permeable wall at least partly covering the transfer chambers, the wall being permeable to air and dust, and at least one low pressure chamber comprising a hood connected to a suction pipe located above and in fluid communication with the air permeable wall.

2. The cleaning machine according to claim 1, further comprising means for setting vacuum pressure in the at least one low pressure chamber.

3. The cleaning machine according to claim 2, wherein said means comprises at least one adjustable throttling member.

4. The cleaning machine according to claim 1, wherein the hood includes at least one inspection window through which accumulated dust on the air permeable wall can be observed.

5. The cleaning machine according to claim 1, wherein the hood includes at least one air inlet for introduction of scavenging air in the at least one low pressure chamber.

6. The cleaning machine according to claim 5, further comprising an adjustable throttling member arranged in the hood air inlet.

7. The cleaning machine according to claim 1, wherein the air permeable wall comprises a perforated sheet which is provided with an electro galvanic coating on a side thereof facing the roller.

8. The cleaning machine according to claim 1, wherein the air permeable wall comprises first, second and third wall sections, the first wall section being horizontally arranged with the second and third wall sections depending therefrom.

9. The cleaning machine according to claim 1, wherein the air permeable wall has a wall thickness (d) which causes the wall to be subjected to vibration by impact with the textile fibre material conveyed in the delivery air when the machine is in operation.

10. The cleaning machine of claim 3, wherein the throttling member comprises a throttle valve.

11. The cleaning machine of claim 1, wherein said at least one low pressure chamber comprises at least first and second low pressure chambers.

12. The cleaning machine of claim 11, further comprising first means for setting pressure in said first low pressure chamber and second means for setting pressure in said second low pressure chamber.

13. The cleaning machine of claim 12, wherein said first means comprises a first adjustable throttling member and said second means comprises a second adjustable throttling member.

14. The cleaning machine of claim 11, wherein the hood includes a first air inlet for introduction of scavenging air into the first low pressure chamber and a second air inlet for introduction of scavenging air into the second low pressure chamber.

15. The cleaning machine of claim 14, wherein a first adjustable throttling member is provided in the first air inlet and a second adjustable throttling member is provided in the second air inlet.

16. The cleaning machine of claim 8, wherein each of the second and third wall sections forms an angle of about 135° with the first wall section.

17. The cleaning machine of claim 1, wherein the air permeable wall includes holes, each of which has a diameter of about 1.5 mm.

18. The cleaning machine of claim 1, wherein the air permeable wall covers only one of the transfer chambers.

19. The cleaning machine of claim 1, wherein the air permeable wall covers only part of one of the transfer chambers.

20. The cleaning machine of claim 1, wherein the air permeable wall covers only part of each of the transfer chambers.

21. The cleaning machine of claim 1, wherein the inlet and the outlet are located above an upper side of the roller.

* * * * *